US005166512A

United States Patent [19]

Kubo

[11] Patent Number: 5,166,512

[45] Date of Patent: Nov. 24, 1992

[54] X-RAY IMAGING TUBE AND METHOD OF MANUFACTURING THE SAME WITH COLUMNAR CRYSTALS AND OPAQUE LIGHT BLOCKING MEANS

[75] Inventor: Hiroshi Kubo, Ootawara, Japan

[73] Assignee: Kabushiki Kaisha Toshiba, Kawasaki, Japan

[21] Appl. No.: 777,909

[22] Filed: Oct. 17, 1991

[30] Foreign Application Priority Data

Oct. 18, 1990 [JP] Japan ..... 2-277676

[51] Int. Cl.[5] ..... H01J 31/50

[52] U.S. Cl. ..... 250/214 VT; 313/525

[58] Field of Search ..... 250/213 VT, 483.1, 486.1; 313/525, 527, 542

[56] References Cited

U.S. PATENT DOCUMENTS 3,852,133 12/1974 Houston .
4,011,454 3/1977 Lubowski et al. .
5,029,247 7/1991 Anno et al. ..... 250/213 VT

FOREIGN PATENT DOCUMENTS 55-150535 11/1980 Japan .
59-49141 3/1984 Japan .

*Primary Examiner*—David C. Nelms
*Attorney, Agent, or Firm*—Cushman, Darby & Cushman

[57] ABSTRACT

An X-ray imaging tube which comprises a vacuum envelope, an input screen comprising a substrate located in the input end of the envelope, an input phosphor layer formed on the substrate and comprising a number of columnar phosphor crystals, and a photoelectric layer formed directly or indirectly on the input phosphor layer, an anode and an ouput screen located in the output end of the envelope, and a beam-converging electrode located in the envelope and extending along the inner surface of the envelope. The tube further comprising optically opaque layers which are formed in each columnar crystal and extending from the surface thereof. A method of manufacturing an X-ray imaging tube, disclosed herein, comprises the steps of vapor-depositing a predetermined phosphor on a substrate, thereby forming on the substrate an input phophor layer consisting of columnar crystals, vapor-depositing a predetermined material, thereby forming an optically opaque layer on the tip of each columnar crystal, sputtering the optically opaque layer, thereby removing a part of the optically opaque layer formed on the tip of the columnar crystal, vapor-depositing said predetermined phosphor, and, if necessary, repeating these steps, thereby forming a plurality of optically opaque layers in each columnar crystal, which extend from circumferential surface of the columnar crystal.

5 Claims, 3 Drawing Sheets

X-RAY IMAGING TUBE AND METHOD OF MANUFACTURING THE SAME WITH COLUMNAR CRYSTALS AND OPAQUE LIGHT BLOCKING MEANS

BACKGROUND OF THE INVENTION

1. Field of the Invention

The present invention relates to an X-ray imaging tube and a method of manufacturing the same, and more particularly to an X-ray imaging tube having an improved input screen.

2. Description of the Related Art

An X-ray imaging tube is a device which comprises a vacuum envelope having an input end and an output end, an input window closing the input end of the envelope, an input screen located within the envelope and opposing the input window, an anode provided within the output end of the envelope, an output screen located in the output end of the envelope, and beam converging electrodes arranged within the envelope, coaxial with each other, and spaced apart in the axial direction of the envelope 1. The input screen comprises a substrate, a phosphor layer formed on the substrate, and a photoelectric layer formed on the phosphor layer.

In operation, X-rays applied to a subject and passing through it are applied to the input screen through the input window. They pass through the substrate, reaching the phosphor layer. The phosphor layer converts the X-rays into light. The photoelectric layer converts the light into electron beams. The beam-converging electrodes converge the electron beams, and the anode accelerates these electron beams. The electron beams are applied to the phosphor layer of the output screen, which emits rays corresponding to the X-rays, forming an X-ray image of the object. Hence, the X-rays are applied to a visible image. This image is recorded by means of a TV camera, a movie camera, a spot camera, or the like. The X-ray image thus recorded is used for diagnosis.

One of the important characteristics of an X-ray imaging tube of this type is its resolving power, i.e., the ability of producing smallest possible separable images of different points on an object. One of the factors determining the resolution is the quality of the input screen of the X-ray imaging tube.

FIG. 1 is an enlarged view of the input screen of a conventional X-ray imaging tube. As can be seen from FIG. 1, the input screen comprises a substrate 1, an input phosphor layer 2 formed on the substrate 1, and a photoelectric layer 3 formed on the phosphor layer 2. The substrate 1 is made of material having high X-ray transparent, such as aluminum or an aluminum alloy. The input phosphor layer 2 is made of material having high X-ray conversion efficiency, such as cesium iodide activated by sodium (CsI:Na). The photoelectric layer 3 is a multi-layer member made of photoelectric materials such as antimony and alkali metal. As is evident from FIG. 1, the input phosphor layer 2 consists of a number of columnar phosphor crystals 2*a*.

In the columnar phosphor crystals 2*a*, X rays 4 applied through the substrate are converted into light beams 5. The light beams 5 propagate in all directions. Those of the beams, which propagate onto circumferential surface of each columnar crystal 2*a* at incidence angle equal to or greater than 33° C., i.e., the critical angle D of CsI:Na, are reflected totally and, hence, do not degrade the resolution of the X-ray imaging tube.

However, those light beams which propagate onto circumferential surface of each crystal 2*a* at incidence angle less than the critical angle D of CsI:Na propagate into the adjacent columnar crystals 2*a*, acting as scattering-light therein and inevitably degrading the resolution of the X-ray imaging tube.

SUMMARY OF THE INVENTION

Accordingly, it is the object of the present invention to provide an X-ray imaging tube in which the light beams propagating sideways in the input screen are absorbed or reflected before they reach the photoelectric layer of the input screen, and which thereby has high resolution, and also to provide a method of manufacturing this X-ray imaging tube.

According to the invention, there is provided an X-ray imaging tube which comprises: a vacuum envelope having an input end and an output end; an input screen comprising a substrate located in the input end of the envelope, an input phosphor layer formed on the substrate and comprising a number of columnar phosphor crystals, and a photoelectric layer formed directly or indirectly on the input phosphor layer; an anode located in the output end of the envelope; a beam-converging electrode located in the envelope and extending along the inner surface of the envelope; and a plurality of optically opaque layers formed in each columnar crystal and extending from the surface thereof.

According to this invention, there is provided a method of manufacturing an X-ray imaging tube, comprising the steps of: vapor-depositing a predetermined phosphor on a substrate, thereby forming on the substrate an input phosphor layer consisting of a number of columnar crystals; vapor-depositing a predetermined material, thereby forming an optically opaque layer on the tip of each columnar crystal; sputtering the surface of the optically opaque layer, thereby removing a part of the optically opaque layer formed on the tip of the columnar crystal; vapor-depositing said predetermined phosphor; and, if necessary, repeating these steps, thereby forming a plurality of optically opaque layers in each columnar crystal, which extend from circumferential surface of the columnar crystal.

Since the optically opaque layers extend from circumferential surface of each columnar crystal toward the inside thereof, they absorb or reflect any light beam propagating sideways, before the light beam reaches the photoelectric layer. The input screen, having the optically opaque layers, can prevent degradation of the resolution of the X-ray imaging tube. In other words, it helps to impart high resolution to the X-ray imaging tube.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
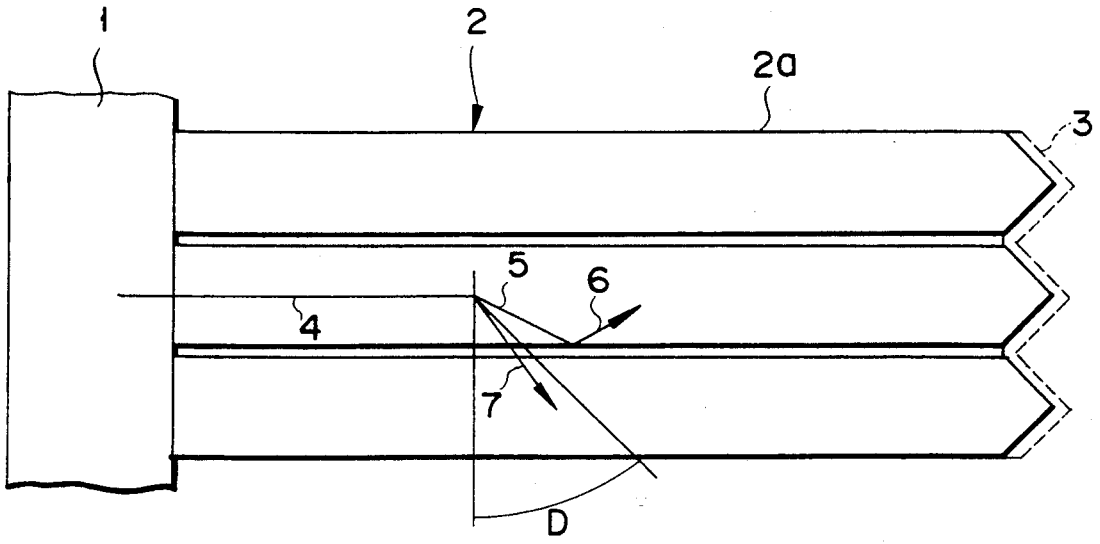
FIG. 1 PRIOR ART
FIG. 1 is an enlarged, cross-sectional view showing the input screen of a conventional X-ray imaging tube.
Figure 2:
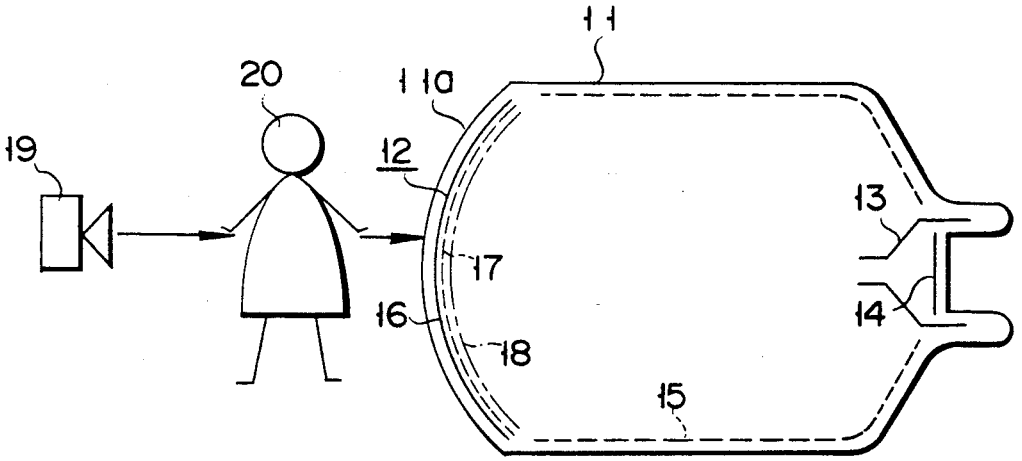
FIG. 2 is a cross-sectional view, schematically showing an X-ray imaging tube according to one embodiment of the present invention.

An X-ray imaging tube according to the invention has the structure illustrated in FIG. 2. As is evident form FIG. 2, the X-ray imaging tube comprises a vacuum envelope 11, an input window 11*a* closing the input end of the envelope 11, an input screen 12 located in the input end of the envelope 11 and opposing the input window 11*a*, an anode 13 located in the output end of the envelope 11, and beam-converging electrode 15 provided in the envelope 11 and extending along the inner surface thereof. The input window 11*a* is made of material having high X-ray transparent, such as aluminum or an aluminum alloy. The input screen 12 comprises a substrate 16 made of material having high X-ray transparent, such as aluminum or an aluminum alloy, a input phosphor layer 17 formed on the substrate 16 and made of material having high X-ray conversion efficiency, such as cesium iodide activated by sodium (CsI:Na), and a photoelectric layer 18 formed on the layer 17. The layer 18 is a multi-layer member made of photoelectric materials such as antimony and alkali metal. (Shown also in FIG. 2 are: an X-ray tube 19, and an subject 20.)

Figure 3:
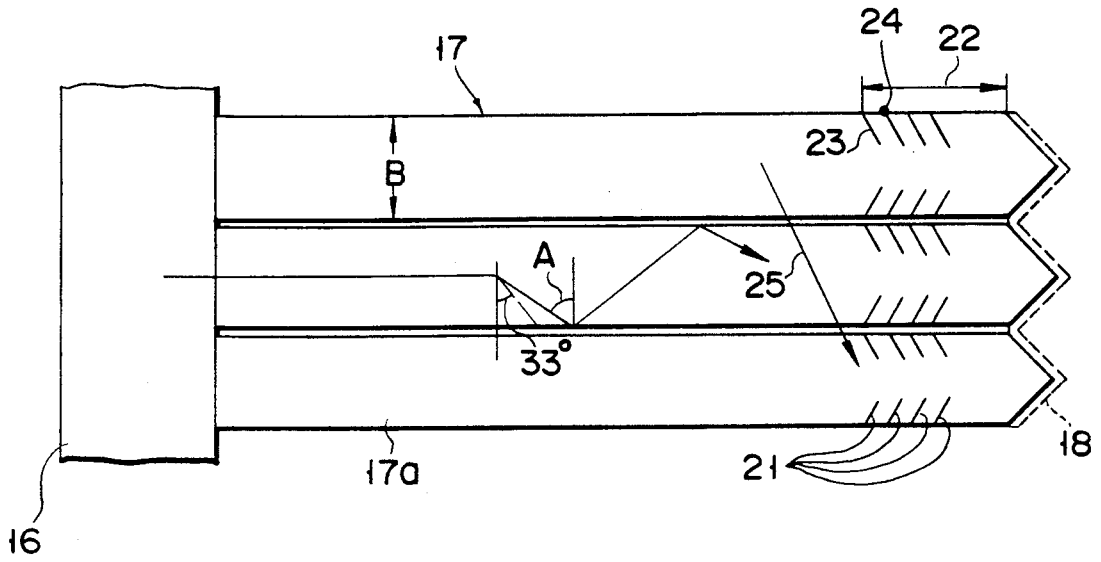
FIG. 3 is an enlarged, cross-sectional view showing the input screen of the X-ray imaging shown in FIG. 2.

FIG. 3 is an enlarged, cross-sectional view of the input screen 12. As this figure clearly shows, the input phosphor layer 17 is formed on the substrate 16, and the photoelectric layer 18 are formed on the input phosphor layer 17. The input phosphor layer 17 consists of a number of columnar phosphor crystals 17*a*, extending perpendicular to the the substrate 16 and spaced apart from each other with a gap between them. Each columnar crystal 17*a* has a square section, one side being about 10 μm long.

In the case where the columnar crystals 17*a* have refraction index of 1.84, any light beam applied to circumferential surface of each crystal 17*a* at an incidence angle of equal to or greater than 33° is reflected totally and does not emerge from the columnar crystal 17*a* at all. Hence, this light beam by no means degrade the resolution of the X-ray imaging tube. However, any light beam applied to circumferential surface of the columnar crystal 17*a* at an incidence angle less than 33° is reflected totally and emerges from the columnar crystal 17*a*, inevitably reducing the resolution of the X-ray imaging tube.

In the present invention, in order to prevent such degradation of resolution, a plurality of optically opaque layers 21 made of, for example, aluminum, is formed in each columnar crystal 17*a*, extending from circumferential surface of the crystal toward the axis thereof. More specifically, these layers 21 are formed in that portion 22 of the crystal 17*a* which is longer than B x tan 33°. Each optically opaque layer 21 inclines such that its inner end 23 is located nearer the photoelectric layer 18 than its outer end 24. Inclining this way, the layer 21 either absorbs or reflects any light beam propagating to its circumferential surface at an incidence angle of less 33°. As a result, such a light beam never reaches the photoelectric layer 18.

It is desirable that the optically opaque layers 21 be located as near the photoelectric layer 18 as possible. This is because the light beams converted from X rays in that portion of each columnar crystal 17*a* which is close to the photoelectric layer 18 reach the photoelectric layer 18, without propagating to the optically opaque layers 21 formed in the columnar crystal 17*a*.

It will now be described how the optically opaque layers 21 are formed in each of the columnar crystals 17*a* forming the input phosphor layer 17.

Figure 4:
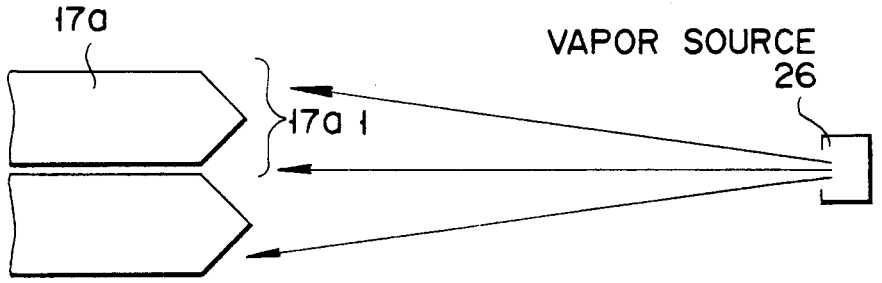
FIG. 4 is a sectional view, explaining one of the steps of a method of manufacturing the X-ray imaging tube shown in FIG. 2.
Figure 5:
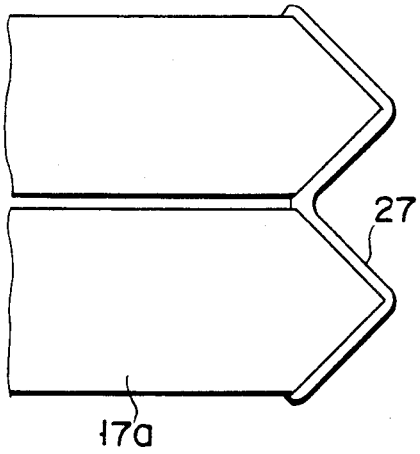
FIG. 5 is a sectional view, explaining another steps of the method.
Figure 6:
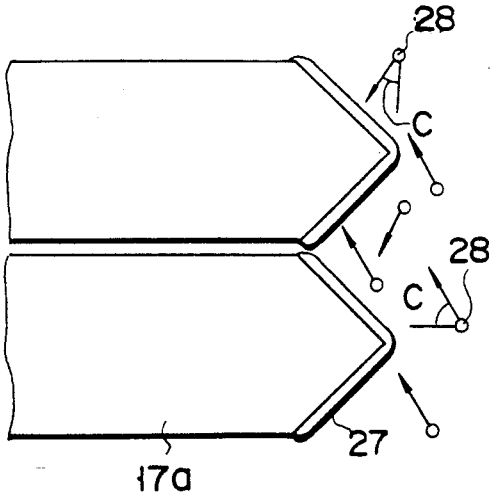
FIG. 6 is a sectional view, explaining still another step of the method.
Figure 7:
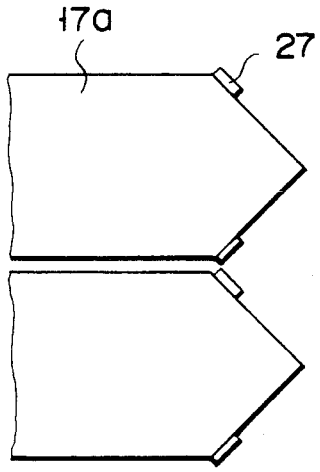
FIG. 7 is a sectional view, explaining another step of the method.
Figure 8:
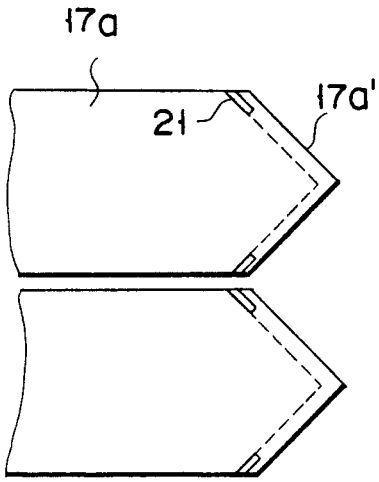
FIG. 8 is a sectional view, explaining another step of the method.
Figure 9:
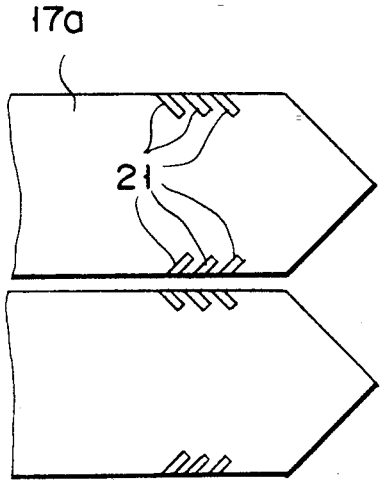
FIG. 9 is a sectional view, explaining still another step of the method.

First, as is shown in FIG. 4, CsI:Na is evaporated in a vapor source 26, and is applied from the source 26 to the substrate 16. Hence, CsI:Na is vapor-deposited, thereby forming columnar crystals 17*a* on the substrate 16. The tip $17a_1$ of each columnar crystal 17*a* is shaped like a cone. (In FIG. 4 which is a cross-sectional view, the tip $17a_1$ is in the form of an isosceles triangle.) Next, as is shown in FIG. 5, the vapor deposition of CsI:Na is stopped, and aluminum is vapor-deposited on the tips $17a_1$ of the columnar crystals 17*a*, forming an optically opaque layer 27 on the tip $17a_1$ of each columnar crystal 17*a*. Further, as is shown in FIG. 6, ions particles 28, such as $Ar^+$ or $F^+$, are impinged at an angle of, for example, 30°, upon the selected portion of the opaque layer 27. As a result, this portion of the layer 27 is removed, only the remaining portion is left on the tip 27 of each columnar crystal 17*a*. Then, as is shown in FIG. 8, CsI:Na is vapor-deposited on the tip $17a_1$ of each columnar crystal 17*a*, thus forming a columnar crystal 17*a'* on the tip $17a_1$. As a result of this, an optically opaque layer 21 having a thickness of 100Å is formed in the columnar crystal 17*a*. Thereafter, the steps explained with reference to FIGS. 5, 6, 7, and 8 are repeated until a plurality of optically opaque layers 21 are formed in the circumferential surface of each columnar crystal 17*a* as is illustrated in FIG. 9.

According to the present invention, the optically opaque layers 21 can be formed of not only aluminum, but also chromium (Cr), nickel (Ni) or nickel-chrome alloy.

The materials of the components forming the input screen 12 are not limited to those specified above. Rather, other materials can be used, so far as they serve to achieve the object of the present invention.

As has been described above, a plurality of optically opaque layers 21 is formed in the circumferential surface of each columnar crystal 17. These layers 21 absorb or reflect any light beam propagating sideways, before the light beam reaches the photoelectric layer 18. The input screen 12, having the optically opaque layers 21, can prevent degradation of the resolving power of the X-ray imaging tube. In other words, it helps to impart high resolution to the X-ray imaging tube.

When the present invention was applied to an X-ray imaging tube whose input screen has an effective diameter of 9 inches, the tube exhibited resolution of 60lp/cm, whereas the conventional X-ray image tube having a 9-inch input screen had only 50lp/cm.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An X-ray imaging tube which comprises:

a vacuum envelope having an input end and an output end;

an input screen comprising a substrate located in the input end of said envelope, an input phosphor layer formed on said substrate and comprising a number of columnar phosphor crystals, and a photoelectric layer formed directly or indirectly on said input phosphor layer;

an output screen located in the output end of said envelope;

an anode located in the output end of said envelope;

a beam-converging electrode located in said envelope and extending along the inner surface of said envelope; and a plurality of optically opaque layers formed in each columnar crystal and extending from the surface thereof.

2. An X-ray imaging tube according to claim 1, wherein said optically opaque layers are made of a metal selected from the group consisting of aluminum, chromium, and nickel.

3. A method of manufacturing an X-ray imaging tube, comprising the steps of:

vapor-depositing a predetermined phosphor on a substrate, thereby forming on said substrate an input phosphor layer consisting of a number of columnar crystals;

vapor-depositing a predetermined material, thereby forming an optically opaque layer on the tip of each columnar crystal;

sputtering said surface of said optically opaque layer, thereby removing a part of said optically opaque layer formed on the tip of said columnar crystal;

vapor-depositing said predetermined phosphor; and repeating these steps, if necessary, thereby forming a plurality of optically opaque layers in each columnar crystal, which extend from circumferential surface of the columnar crystal.

4. A method according to claim 3, wherein the ion gas used in sputtering said surface of said optically opaque layer is one selected from the group consisting of $Ar^+$ and $F^+$.

5. A method according to claim 3, wherein the ion gas used in sputtering said surface of said optically opaque layer is one selected from the group consisting of $Ar^+$, $F^+$, $Xe^+$.

* * * * *